US010158172B2

(12) United States Patent
McGeehan et al.

(10) Patent No.: US 10,158,172 B2
(45) Date of Patent: Dec. 18, 2018

(54) HIGH-POWER MICROWAVE BEAM STEERABLE ARRAY AND RELATED METHODS

(71) Applicant: BAE Systems Information and Electronic Systems Integration, Inc., Nashua, NH (US)

(72) Inventors: John E. McGeehan, Washington, DC (US); Yannick C. Morel, Falls Church, VA (US); Alexander B. Kozyrev, Rockville, MD (US); Simon Y. London, Rockville, MD (US); Clint J. Novotny, Washington, DC (US); Somnath Sengupta, Ellicott City, MD (US); Yeuan-Ming Sheu, Berwyn Heights, MD (US); Mark T. Walter, Annapolis, MD (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 446 days.

(21) Appl. No.: 14/881,577

(22) Filed: Oct. 13, 2015

(65) Prior Publication Data

US 2016/0126628 A1 May 5, 2016

Related U.S. Application Data

(60) Provisional application No. 62/072,583, filed on Oct. 30, 2014.

(51) Int. Cl.
*H01Q 3/26* (2006.01)

(52) U.S. Cl.
CPC ..... *H01Q 3/2682* (2013.01); *H01Q 3/2676* (2013.01)

(58) Field of Classification Search
CPC ..... H01Q 3/2682
USPC ..... 342/14
See application file for complete search history.

(56) References Cited

U.S. PATENT DOCUMENTS 5,481,232 A * 1/1996 Wu ..... H01P 1/185 333/161
8,400,355 B1 * 3/2013 Gaeta ..... H01Q 3/2682 342/368
8,976,061 B2 * 3/2015 Chowdhury ..... G01S 7/032 342/11

* cited by examiner

*Primary Examiner* — Peter M Bythrow
*Assistant Examiner* — Helena H Seraydaryan
(74) *Attorney, Agent, or Firm* — Hayes Soloway PC; Scott J. Asmus

(57) ABSTRACT

A steerable high-power microwave beam array includes an optical sub-system comprising a laser and an optical time delay unit and a parallel set of RF time delay units. The optical system and/or the RF delay subsystem are utilized to precisely delay the pulses from the microwave antenna elements to provide steerable beam forming.

17 Claims, 7 Drawing Sheets

HIGH-POWER MICROWAVE BEAM STEERABLE ARRAY AND RELATED METHODS

CROSS REFERENCE TO RELATED APPLICATION

This application claims benefit of U.S. Provisional Application Ser. No. 62/072,583 entitled, "HIGH POWER MICROWAVE BEAM STEERABLE ARRAY" filed Oct. 30, 2014 the entire disclosure of which is incorporated herein by reference.

FIELD OF THE INVENTION

This invention relates to directed-energy weapons, and more particularly, to high-power microwave arrays that produce high-energy pulses on target.

BACKGROUND OF THE INVENTION

The conventional solution for increasing high-power microwave (HPM) power is making the source bigger, including increasing the number of modules, and making antennas bigger. However, platform constraints typically make the increase of the HPM source size impractical, thereby limiting the number of elements which can be used in a given system.

More particularly, with high-power microwaves, in order to improve the amount of energy on target a number of antennas are carried on a moving platform such as an aircraft or missile in which the antennas are directional. These directional antennas provide a fixed beam so that the outgoing energy goes out only in one direction towards the target. In a typical tactical scenario, in order to place the energy on target one must physically move the antennas to point at the target or physically move the entire platform, e.g., physically move the aircraft or missile. When the platform is moving in a direction other than that which points the antenna at the target, such as in a forward direction, a sideways direction, or another direction, the platform would be required to turn back to point at the target or another direction of aim. Thus, the ability to do mission planning is limited because of the fixed positioning of the antenna, where pointing the antenna is dependent upon the orientation of the platform.

Another problem with HPM systems is the present pointing accuracy. Conventional pulsed HPM systems do not have accurate timing control and do not have an easy or straightforward solution for beam steering. For steering the beam of energy, in terms of the pulses, the use of a mechanism to locate many shots on target will provide a decent opportunity to take out the target. However, if the antennas are only pointing in one direction because they are fixed to the platform, the time at which the pulses can be turned on and off can be significantly limited.

To illustrate this principle, consider an analogy using a machine gun. If it is desirable to strafe a target with multiple shots using a fixed machine gun, it can only be done when the fixed machine gun is directly aiming at the target. Similarly, if it is desirable to strafe a target with multiple high-energy pulses, it can only be done when the vehicle with its antenna is directly aiming at the target. However, if the target is sideways with respect to the orientation of the antenna, it will be necessary to wait to maneuver the vehicle so that the vehicle-mounted antenna is pointed at the target. When the vehicle is properly aligned with the target direction, the pulses can be generated. As a result, as the vehicle passes by the target, firing can only commence once the target is immediately in the aim of the antenna.

Further, if the system aboard the vehicle is provided with the ability to dynamically point at the target as the vehicle moves by, it is possible to get more pulses on the target and therefore be more effective in taking out the target due to the buildup of the high-energy pulses. This principle assumes one can continue to shoot pulses while approaching the target or moving away from the target. In other words, shooting pulses would not be constrained to having the target positioned directly in front of the antenna.

The problem, however, is how to be able to project high-energy pulses towards a target in a steerable manner. For phased array radars, it is fairly well known that beams can be steered by adjusting the phase of the signals at an array of antennas. However, it is not at all clear how to phase ultra-short high-power pulses. Moreover, it is likewise not clear how to calculate the phase of ultra-short pulses projected by multiple antennas where there is no necessary instantaneous phase relationship between these pulses. While it is possible in conventional phased array radars to ascertain the phase relationship between continuous waves, it is not entirely clear how one could adapt phased array technology to provide beam steering for high-energy pulsed systems.

Although the concept of phased array beam steering is well developed for continuous wave low power sources, conventional pulsed HPM systems do not have accurate timing control, and thus do not have an easy or straight forward solution for beam steering. Furthermore, the possibility of constructive interference of short pulses within a wide steering angle has been thought to be questionable at best. Additionally, the idea of using a large number of very small elements stacked together in an array and to control the timing of the projection of the pulses at each of these elements to get a beam steering effect has not been possible due to the fact that, when dealing with individual pulses, it had not been proven that one could effectively time the leading edges of these pulses with highly precise phase delays to provide the appropriate beam steering characteristic.

Thus, a heretofore unaddressed need exists in the industry to address the aforementioned deficiencies and inadequacies.

SUMMARY OF THE INVENTION

Embodiments of the present disclosure provide an apparatus, system, and method for illuminating a target with a set of high power microwave pulses from a vehicle moving with respect to the target so as to increase the number of high power microwave pulses impinging on the target. Briefly described, in architecture, one embodiment of the system, among others, can be implemented as follows. A microwave radar generates a set of high-power microwave pulses utilizing an array of microwave elements so as to form a beam. A beam steering unit steers the beam towards the target, whereby the beam from the vehicle tracks the target as the vehicle moves past the target.

The present disclosure can also be viewed as providing a method for illuminating a target with a set of high power microwave pulses from a vehicle moving with respect to the target to increase the number of high power microwave pulses impinging on the target. In this regard, one embodiment of such a method, among others, can be broadly summarized by the following steps: generating the set of high-power microwave pulses utilizing an array of microwave elements to form a beam; and steering the beam towards the target, whereby the beam from the vehicle can be made to track the target as the vehicle moves past the target.

The present disclosure can also be viewed as providing a method for steering a high power microwave array beam. In this regard, one embodiment of such a method, among others, can be broadly summarized by the following steps: providing a plurality of microwave elements in an array; coupling each of a plurality of microwave pulses to a different microwave element in the array; and varying a time of production of microwave pulses prior to the coupling of the produced microwave pulse to the associated microwave element.

The present disclosure can also be viewed as providing a steerable high-power microwave beam array. Briefly described, in architecture, one embodiment of the system, among others, can be implemented as follows. An optical sub-system comprises a laser, an optical time delay unit, and a parallel set of amplifiers, wherein the laser connects to the optical time delay unit, and wherein the optical time delay unit connects to the set of amplifiers. An RF sub-system comprises a parallel set of high-power microwave modules and a parallel set of RF time delay units, wherein the set of amplifiers connects to the set of high-power microwave modules, and wherein the set of high-power microwave modules connects to the set of RF time delay units. An antenna array comprises a plurality of ultra-wide band antennae, wherein the plurality of ultra-wide band antennae connects to the set of RF time delay units.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
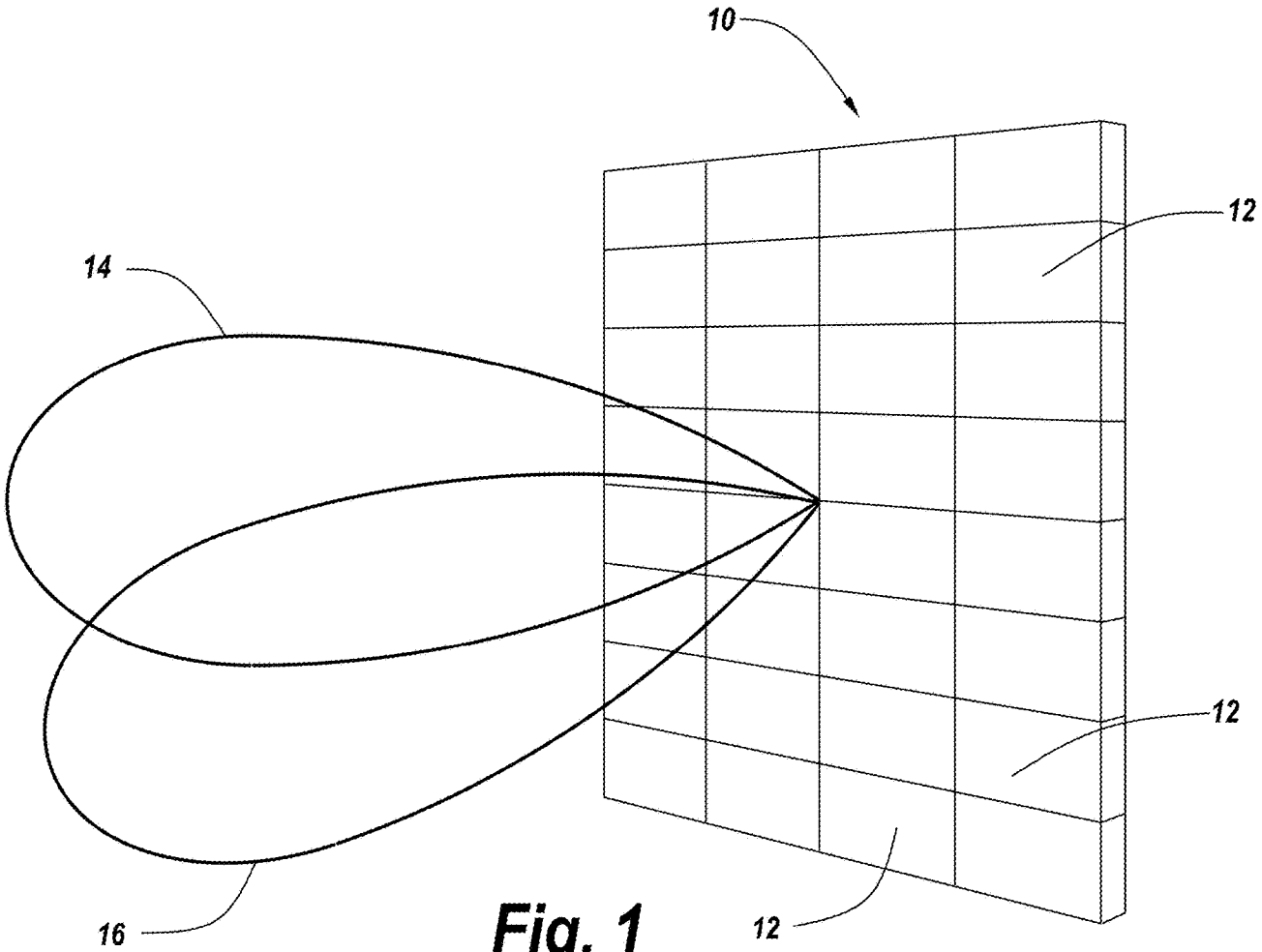
FIG. 1 is a diagrammatic representation of a high power pulsed beam steering system in which the major lobe from an array of microwave elements is steerable with the phasing of the pulses from the individual microwave horns, in accordance with a first exemplary embodiment of the present disclosure.

To improve on the shortcomings of the conventional art, and provide steerability to high-power pulses coming from an array, the subject invention involves pulse generation timing including an optical time delay or RF time delay, or both. As to optical time delay, modules having laser controlled photoconductive switches may be used. As to RF time delay, delay controllable transmission lines may be used. In each case, pulses emanating from the array elements may have the requisite phase delay for beam steering. As will be seen below, the two delay systems can be used independently or together.

In the present disclosure, there may be two different types of mechanisms to control the timing of the pulses that are emitted. The two mechanisms to control the timing of the leading edges of these pulses involves either (1) the use of an optical delay line, so that the pulses to each of the modules in the array are precisely delayed with respect to each other to provide the beam steering function, or (2) a controllable RF delay is interposed in each of the transmission lines to each of the antennas to establish the phase relationship of the pulses outputted from the antennas. It is been found that both of these mechanisms can be used either singly or in combination to provide for the accurate generation of pulses from the antennas in the array and thus beamforming.

In one embodiment, a module is provided for each of the antennas in the array, with each of the modules including a photoconductive switch which connects a high voltage source to ground to provide a negative going pulse on a transmission line that is then coupled to a microwave antenna in the array. Alternatively, a positive pulse can be generated with appropriate switch reconfiguration. When using an optical delay line, photoconductive switches are keyed by the signals from an optical delay line such that each of the nodules is triggered at the time the optically delayed pulse arrives at the associated switch. With this type of timing, it was found that constructive interference for the pulses emitted at the antenna elements can be obtained. The timing is such that the triggering pulses are separated by a number of picoseconds, such that, for example, a first module is triggered and the next module is triggered a period of time later. In one example, the time period between triggering pulses may be 50 picoseconds.

It is difficult by conventional means to generate triggering pulses that will retain the coherence of all of the modules relative to each other. However, with an optical delay system described herein to establish the precise timing of the optical switches in each of the modules, the requisite coherence can be established. On the other hand, it is possible to use a single laser trigger to simultaneously key each of the switches in each of the modules and to provide a variable RF delay in the transmission line between the switches and the associated antennas to establish the precise delay between the generation of the pulses at the associated antennas. The RF delay system assumes that each of the high power pulses is initiated at exactly the same time by a single laser trigger coupled to the photoconductive switches.

It is a finding of the subject invention that rather than using continuous wave phasing techniques, it is possible to establish the appropriate phase relationship for the pulses emanating from each of the microwave horns in the array. It has also been found that the same sort of coherence and beam steering, when generating short high power pulses in the manner described herein, can be obtained as one obtains from a conventional CW phased array system. Thus, a key finding of the subject invention is that it is possible to steer a beam formed by high power microwave pulses from an array. This ability allows great flexibility and planning for a particular mission because one has the freedom to move the platform and not depend on platform position to accomplish beam steering.

A second result of the ability to steer the high power microwave pulses is to dramatically increase the effective energy on the target because of considerable dwell time. Thus, as a vehicle is approaching a target, it is possible to point at the target and shoot and then move the beam with each shot so as to concentrate the energy on the target as the vehicle is moving past the target. Accordingly, without spending more fuel or power, it is possible to dramatically increase the effect of pulses built up on the target regardless of the relative motion of the vehicle and the target. Additionally, in one embodiment, a single trigger laser and an optical delay line provide the trigger pulses to the photoconductive switches so that very precise timing control can be established. On the other hand, when choosing to omit the optical delay line, one can provide the transmission line between the photoconductive switch and the associated antenna. One may then provide a controllable RF delay in the form of an impedance transformer in which the RF delay is controlled by the application of a control signal across the delay line to precisely control the associated delay.

The RF time delay unit can be implemented either as ferrite-based or ferro-electric tuned time-delay transmission lines, among many possibilities. In one embodiment, a nonlinear material is incorporated into a parallel plate waveguide structure and the time delay is controlled by an external magnetic or electric field. In a preferred embodiment, the RF delay unit constitutes an impedance transformer for energy storage. In one embodiment, the transformer consists of a number of layers of conductive layers in a waveguide separated by very highly insulating dielectric material, with the layers of insulating material progressively getting thicker. A voltage is applied to change the dielectric constant of the various layers to alter the time it takes for a wave to cross the material. By doing so, it is possible to control the delay associated with the impedance transformer with a granularity that is as small as 50 picoseconds. This type of control can generate a phase difference corresponding to 50 picoseconds between the pulses from associated modules. By applying a different voltage across each of the transformers in each of the modules it is possible to precisely specify the delays associated with each of the modules.

The photoconductive switches can generally operate in two modes. The first mode is a linear mode and the second mode is an avalanche breakdown mode. When working in the avalanche breakdown mode, only a very small amount of light is needed to trigger the switch because the avalanche breakdown is a statistical effect. However, the avalanche mode does not provide particularly good timing control. Thus, the switches might not trigger at exactly the same time, which may be a key aspect to the operation of the subject system. The result is that the photoconductive switches are made to operate in a linear mode, which, while requiring more optical energy to trigger the switch, guarantees that with a single activating laser pulse every switch is going to trigger at exactly the same time.

Ultimately, optical delayed pulses from a single laser source can be utilized to control the phasing of high energy microwave pulses so as to establish the required delay for beam steering. Alternatively, all of the photoconductive switches in each of the modules may be triggered simultaneously from a single laser source without the use of an optical delay, with the required delays being created by RF delay transformers controlled by the voltages applied to each of the individual transformers. It has also been found that the beam steering of the type described can be used to overcome output power limitations of present HPM systems. To this end, the beam steering may: (1) increase peak power on target by focusing the energy on target; (2) increase dwell time, by eliminating the dependence on the position of the platform relative to the target; (3) focus the energy away from undesirable targets; and (4) decrease cost, size, weight, input power for systems by requiring fewer HPM sources. Thus, the present disclosure can provide for a modular single- or multi-cycle optically triggered system that allows for realization of efficient beam steering in a pulsed regime at very high output power level with exceptional pulse generation precision.

FIGS. 1-8 are provided to further describe the subject disclosure in detail. FIG. 1 is a diagrammatic representation of a high power pulsed beam steering system 10 in which the major lobe from an array of microwave elements is steerable with the phasing of the pulses from the individual microwave horns 12, in accordance with a first exemplary embodiment of the present disclosure. As shown, the high power pulse beam steering array 10 may be composed of an array of elements in the form of microwave horns 12 oriented so as to project a first beam 14 in a direction dictated by the phasing of the pulses from the microwave horns 12. Specifically, the first beam 14 represents the direction of the major lobe of the array 10 when the high-energy pulses arrive at each of the microwave horns 12 simultaneously, whereby the direction of the first beam 14 is along the center line of the microwave horns 12. In contrast to the first beam 14, the second beam 16 is shown at a distinct direction. The subject disclosure allows steering of the first beam 14 from the direction illustrated to the direction as illustrated by the second beam 16 by phasing of the pulses from each of the microwave horns 12.

It is a finding of the subject disclosure that it is possible to phase the high-energy single transient pulses from the array so that there is coherence in a direction dictated by the phasing or delay between the pulses that arrive at each of the microwave horns 12. This finding is true regardless of the fact that, rather than being continuous wave signals in a phased array, the pulses are transient in that they do not individually exhibit a particular frequency. In short, the frequency of a transient pulse may be undefined. As will be seen, the timing of the pulses to each of the microwave horns 12 may be dictated by a number of modules equal to the number of elements in the array 10, with the modules generating the high-energy pulses and timing them so that there is a defined phase relationship between the high-energy pulses emitted by the microwave horns 12.

Figure 2:
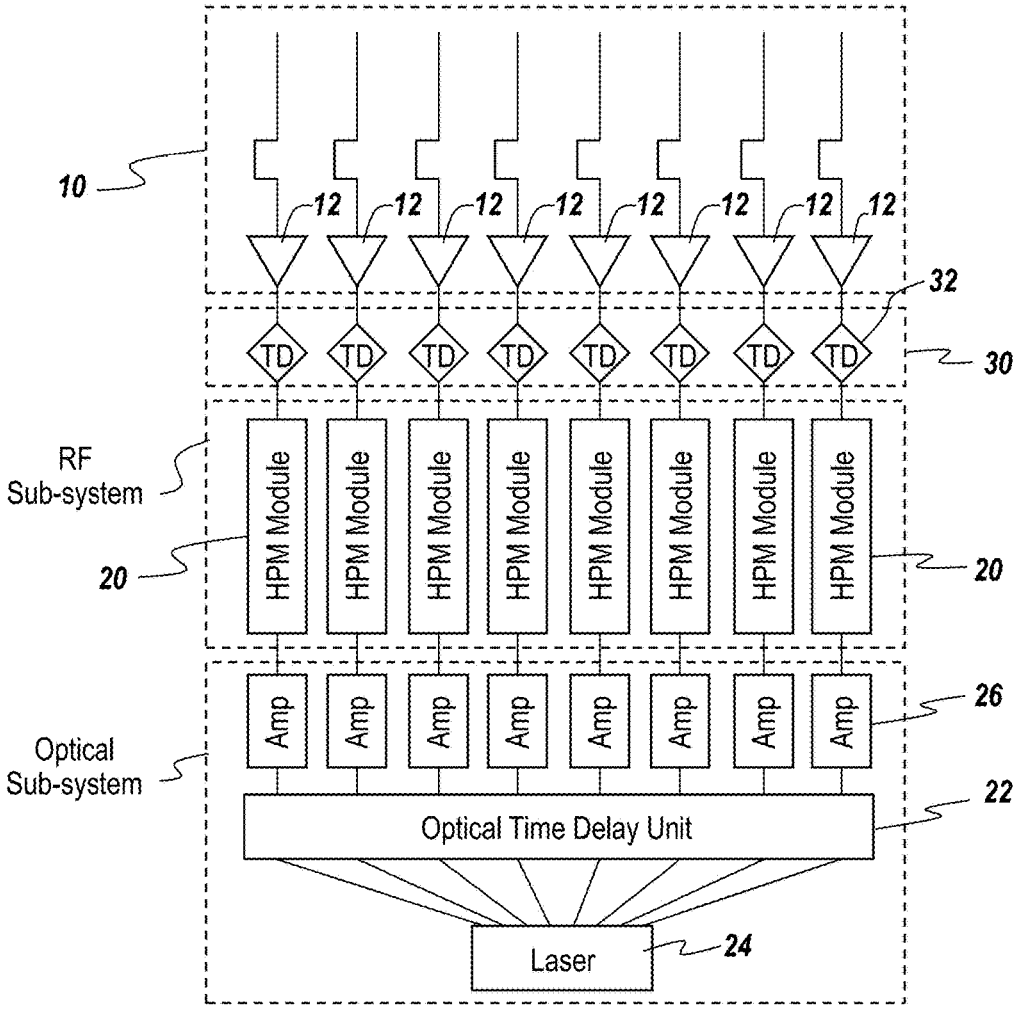
FIG. 2 is a block diagram of a system for either optically delaying or RF time delaying high-energy pulses from a high power microwave module in which optical delays are provided by an optical time delay unit and in which RF time delays are provided by RF delay units, in accordance with the first exemplary embodiment of the present disclosure.

FIG. 2 is a block diagram of a system for either optically delaying or RF time-delaying high-energy pulses from a high power microwave module in which optical delays are provided by an optical time delay unit and in which RF time delay are provided by RF delay units, in accordance with the first exemplary embodiment of the present disclosure. As shown in FIG. 2, the microwave horns 12 in array 10 are driven by pulses generated by HPM modules 20. Each HPM module 20 may consist of a photoconductive switch, a transmission line and an impedance transformer for energy storage. A laser 24 is used to key the photoconductive switches to discharge the associated transmission line via generation of photocarriers within the switch.

The timing of the pulses from each of modules 20 is determined by an optical time delay unit 22 in the form of an optical delay line for the pulses from laser 24 and distributes the delayed pulses through amplifiers 26 to the associated HPM modules 20. Thereafter, an RF time delay 30 composed of individual time delay units 32 delays the pulses from each of the HPM modules in a controlled manner, with the delayed pulses being coupled to the antenna array elements 12, as illustrated. As a result, the beam steerable array uses optical delay units 22 and/or RF time delay units 32 to provide a specific time delay between the pulses generated by adjacent modules, which is necessary for continuous beam steering. The RF time delay unit can be implemented either as ferrite-based or ferro-electric time-delay transmission lines. As will be described, nonlinear material is incorporated into a parallel plate waveguide structure and the time delay is controlled by an external magnetic or electric field. In one embodiment, the antenna units are TEM horn antennas or any other type of ultra-wide band antennas.

Figure 3:
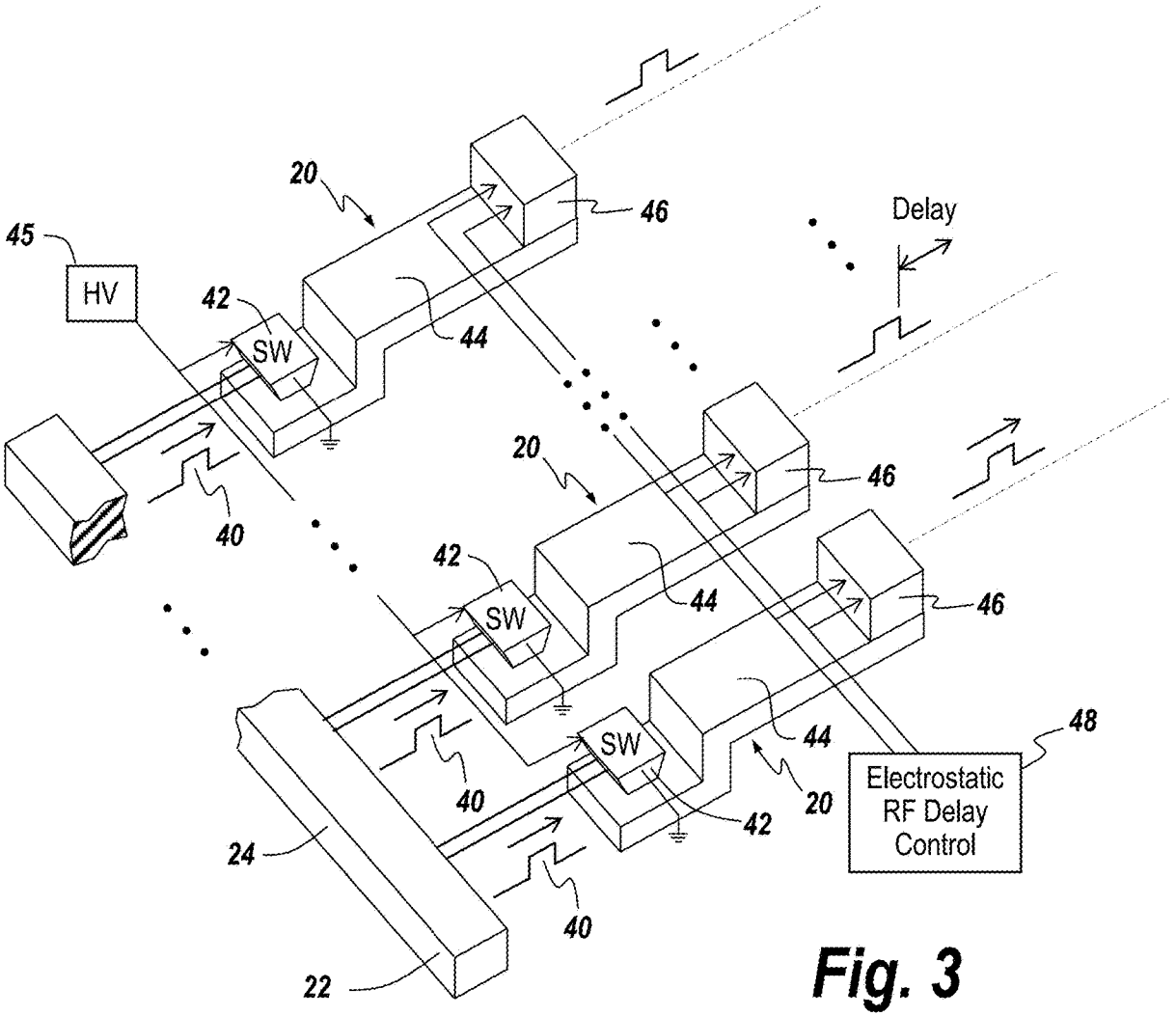
FIG. 3 is a diagrammatic illustration of the high-power microwave modules of FIG. 2, in accordance with the first exemplary embodiment of the present disclosure.

FIG. 3 is a diagrammatic illustration of the high-power microwave modules of FIG. 2, in accordance with the first exemplary embodiment of the present disclosure. Specifically, the precise timing of the pulses delivered to the antenna array elements may be determined by the system, as shown in FIG. 3, in which optically delayed pulses 40 from optical delay line 22 are coupled to switches 42 in each of the HPM modules 20. The phasing of pulses 40 from the laser 24 constitutes one method of phasing the high-energy pulses emitted from the microwave horns. It is noted that the high-energy pulses are generated by coupling a high-voltage source 45 to switches 42 which momentarily grounds the high-voltage producing a negative going pulse which is delivered to a microwave waveguide 44 coupled to an RF delay unit 46, in one embodiment an active transformer having tunable dielectric material. The tunable dielectric transformers cause an RF signal delay in one embodiment under the control of an electrostatic RF signal delay control unit 48 so as to further precisely delay the pulses that emanate from the action of switches 42.

The phasing of the high-energy pulses from the antenna array elements can be either controlled by the optical delays of the laser pulses, or by the delays produced by the RF delay section which precisely delays pulses to each of the microwave horn elements. In one mode of operation, laser pulses are coupled to switches 42 with a prescribed delay that results in a similar delay in the pulses generated by the activation of the switches. In another mode of operation, the pulses from the laser are delayed identically such that they arrive at each of switches 42 simultaneously. Thereafter, the high-energy pulses generated by the switches are time delayed in a controlled manner by RF delay devices 46. It will be appreciated that the two time delay methods for controlling the generation of the high-energy pulses disclosed herein may be used either singly or in combination to control the leading edge of the pulses generated at the microwave horn elements.

Figure 4:
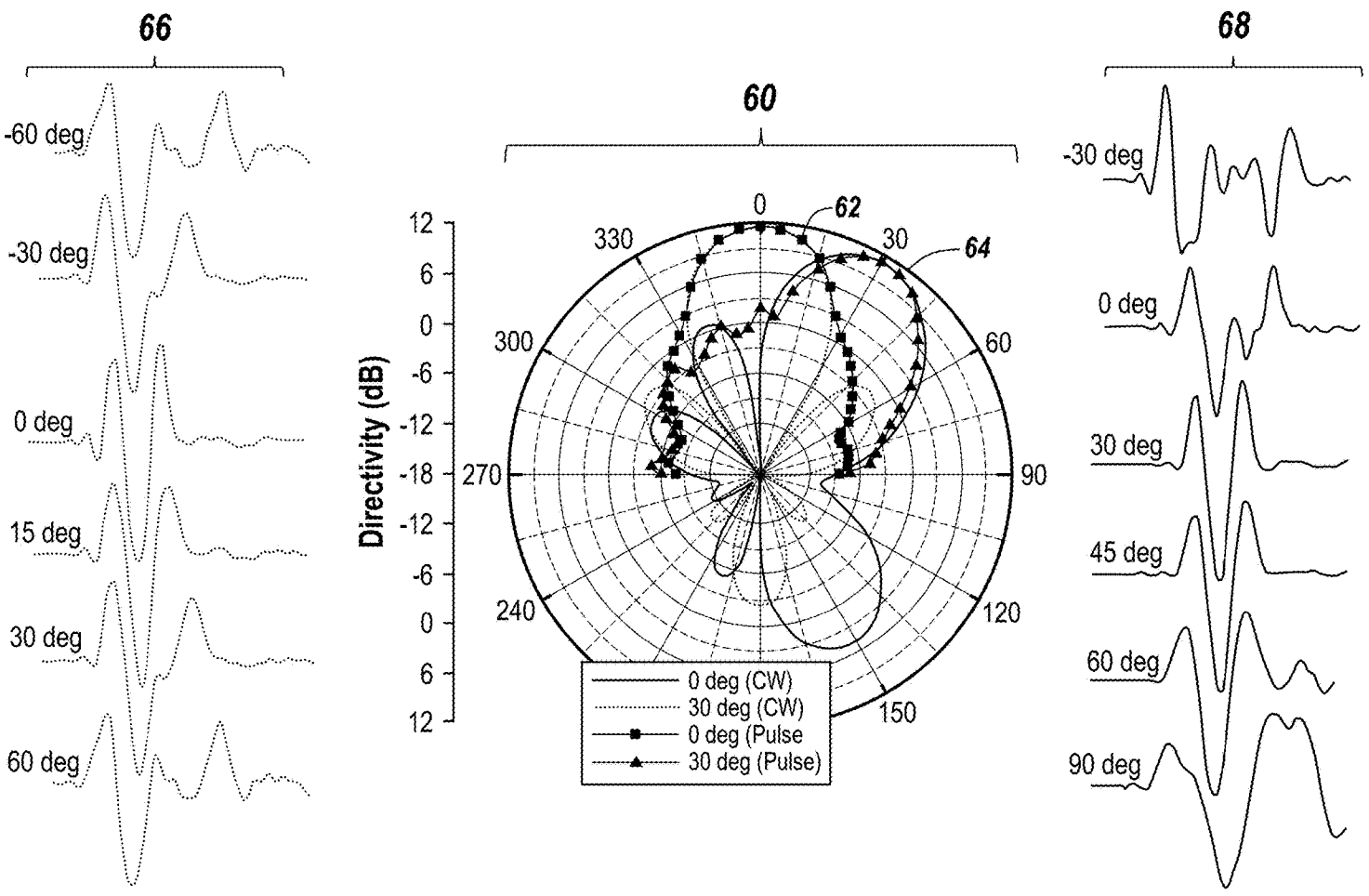
FIG. 4 is a radiation pattern showing beam steering capabilities of the system of FIG. 2, also showing radiated waveforms for pulsed and CW modes, in accordance with the first exemplary embodiment of the present disclosure.

FIG. 4 is a radiation pattern 60 showing beam steering capabilities of the system of FIG. 2, also showing radiated waveforms 66, 68 for pulsed and CW modes, in accordance with the first exemplary embodiment of the present disclosure. The radiated beam pattern producible by the phasing of the transient pulses from the microwave horn elements is shown by radiation pattern 60 such that the major lobe or maxima. 62 of the array is projected along the zero axis. By altering the phase of the leading edges of the single pulses generated at the microwave horns, the major lobe 62 may be beam steered to the position illustrated by steered major lobe or maxima 64, which is positioned 30° off-center. The radiated waveforms 66 and 68, corresponding to the radiation pattern 60, describe the pulse shapes for the emitted pulses correlated to the beam steering directions illustrated. Here, the radiated waveforms show a striking resemblance between those generated in CW beam forming and those pulses produced by the subject system. The result is that the same type of beam steering affordable in a CW mode is available in the pulsed mode.

Results of exemplary simulations as shown in FIG. 4, carried out for a 2×4 array of exponentially flared TEM horns, demonstrate that modular single-pulse arrays are time-delay steerable. Thus, the simulations show coherent summation of pulsed signals in the direction of the non-steered major lobe or maxima 62 to the steered major lobe or maxima 64. Furthermore, pulse shape and peak power in the direction of the maxima are nearly identical to CW for all steering cases.

Figure 5:
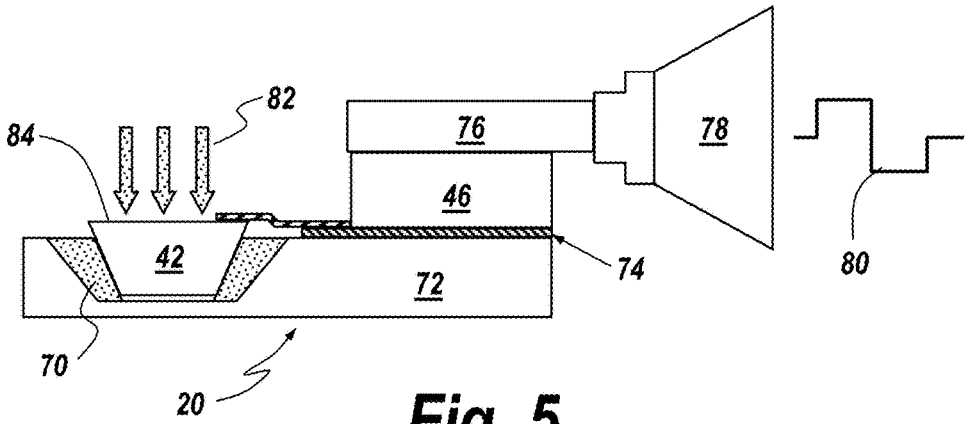
FIG. 5 is a diagrammatic illustration of one of the modules of FIG. 2 illustrating the embedding of a switch in a cradle and the mounting of an active transformer coupled to a microwave horn antenna on the cradle, in accordance with the first exemplary embodiment of the present disclosure.

FIG. 5 is a diagrammatic illustration of one of the modules 20 of FIG. 2 illustrating the embedding of a switch 42 in a cradle 72 and the mounting of active transformer 46 coupled to a microwave horn antenna 78 on the cradle, in accordance with the first exemplary embodiment of the present disclosure. The module 20 includes the switch 42 carried in a pocket 70 in a cradle 72, with the switch being connected by a thin film transmission line 74 to an active transformer 46 which is in turn coupled at structure 76 to antenna horn 78. The pulse shape at the output of this antenna is as illustrated by waveform 80. As can be seen, laser light 82 activates switch 42 upon impinging on the top surface 84 of the switch which, as previously mentioned, grounds a high-voltage applied to the switch to generate the negative going output pulse.

Figure 6:
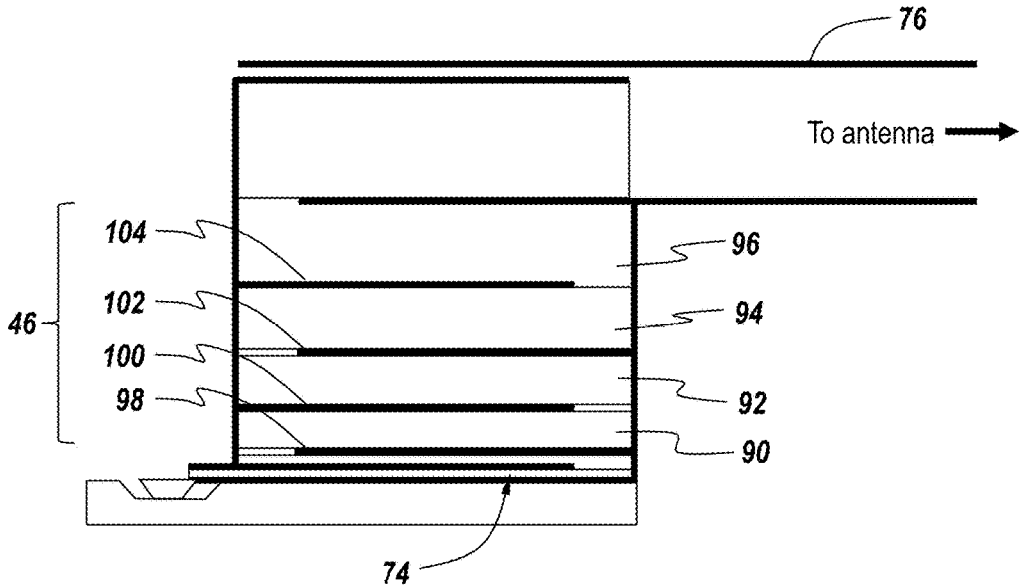
FIG. 6 is a diagrammatic illustration of the active transformer of FIG. 5 illustrating dielectric layers in a waveguide in which the dielectric layers have exponentially varying thicknesses, with the active transformer being able to vary the transit time of waves in the waveguide in accordance with variation in the dielectric constant of the dielectric layers, in accordance with the first exemplary embodiment of the present disclosure.

FIG. 6 is a diagrammatic illustration of the active transformer 46 of FIG. 5 illustrating dielectric layers in a waveguide in which the dielectric layers have exponentially varying thicknesses, with the active transformer being able to vary the transit time of waves in the waveguide in accordance with variation in the dielectric constant of the dielectric layers, in accordance with the first exemplary embodiment of the present disclosure. Relative to the construction of the active transformer 46, a number of layers 90, 92, 94 and 96 are interspersed with metallized layers 98, 100, 102 and 104 to provide an RF delay of signals traversing transmission line 74, with the delayed signals coupled to antenna 78 via microwave line 76 as illustrated. The number of layers may include 6-8 layers, or another quantity of layers, depending on design. It will be appreciated that the thicknesses of dielectric layers 90, 92, 94 and 96 may grow exponentially, in one embodiment, with the delay associated with waves passing through each of these layers dictated by the dielectric constant of the material which is alterable by the application of an electric field across it. Thus, it is the strength of the electric field which determines the delay associated with the corresponding active transformer.

Figure 7A:
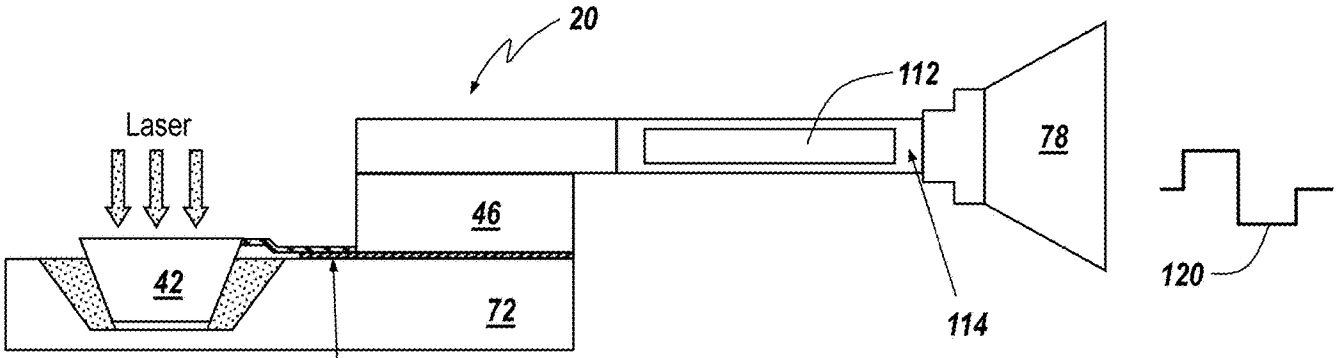
FIGS. 7A and 7B are a side and top view, respectively, of FIG. 2 illustrating switch placement, transformer placement and side-mounted electrodes for the tuning of the active transformer, in accordance with the first exemplary embodiment of the present disclosure; and, FIG. 8 is a representation of the output of a microwave array for fixed beam generation and beam steering to show the improved on target effectiveness when using high power microwave pulse beam steering, in accordance with the first exemplary embodiment of the present disclosure.
Figure 7B:
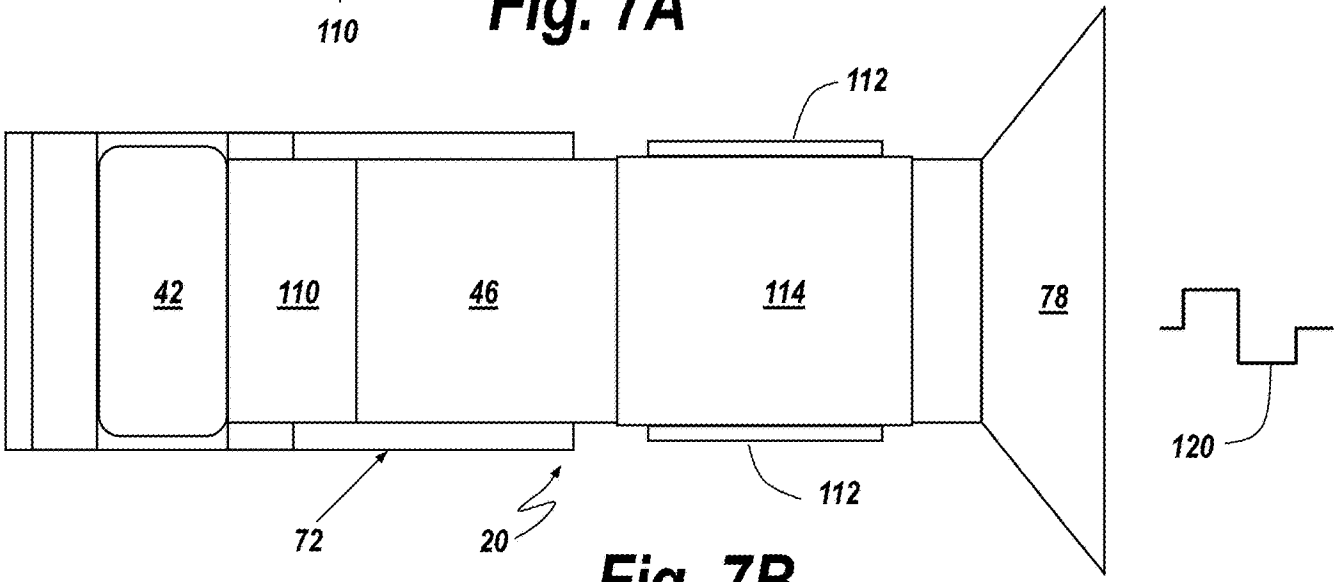

FIGS. 7A and 7B are a side and top view, respectively, of the modules 20 of FIG. 2 illustrating switch placement, transformer placement and side-mounted electrodes for the tuning of the active transformer, in accordance with the first exemplary embodiment of the present disclosure. The structure of module 20 of FIG. 5 is shown in FIGS. 7A-7B in which switch 42 is coupled to active transformer 46 by connecting foil 110. Here, side-mounted electrodes 112 tune the tunable dielectric material 114 through the application of the appropriate voltage thereacross. The result is that pulses 120 from an antenna 78 are controlled in shape and most importantly timing by the RF delay mechanism described previously.

Figure 8:
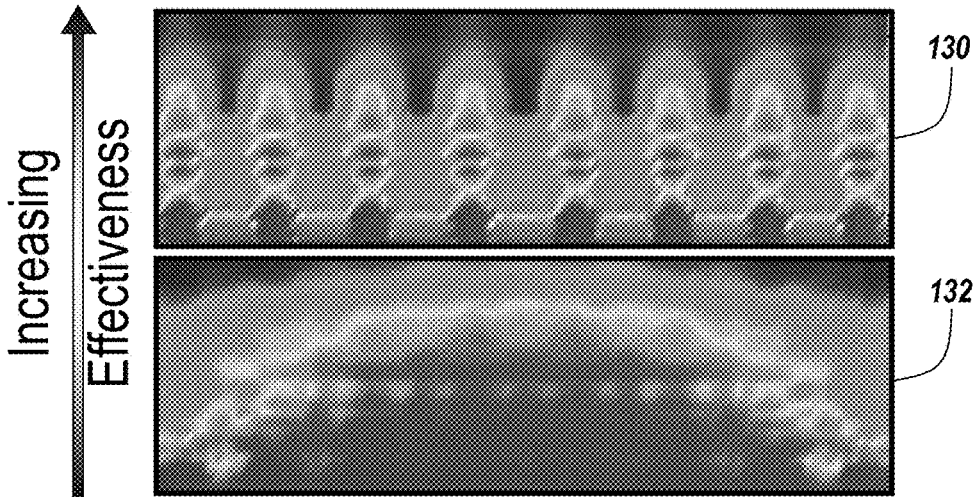

FIG. 8 is a representation of the output of a microwave array for fixed beam generation and beam steering to show the improved on target effectiveness when using high power microwave pulse beam steering, in accordance with the first exemplary embodiment of the present disclosure. Specifically, a fixed beam pattern from each of the elements of the array 130 and a pattern with beam steering 132 are shown. Here, it will be seen that the amount of energy on target for the fixed beam is limited to an exceptionally narrow beam width, whereas with beam steering the amount of energy on target is spread out such that pulses that are emitted during a flyby of a vehicle with respect to the target have improved effectiveness in that the target is always illuminated by the pulses since the beam can be steered towards a target during the flyby.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A steerable high-power microwave beam array comprising:

an optical sub-system, wherein the optical sub-system comprises a laser, an optical time delay unit configured to delay a plurality of light pulses with respect to each other, and a parallel set of amplifiers, wherein the laser connects to the optical time delay unit, and wherein the optical time delay unit connects to the set of amplifiers to provide optically delayed light pulses;

an RF sub-system, wherein the RF sub-system comprises a parallel set of high-power microwave modules having photoconductive switches wherein the high-power microwave module is configured to initiate high-power microwave pulses via the optically delayed light pulses coupled to the photoconductive switches, and a parallel set of RF time delay units coupled to the high-power microwave pulses; and an antenna array, wherein the antenna array comprises a plurality of ultra-wide band antennae, wherein the plurality of ultra-wide band antennae connect to the set of RF time delay units and provide the steerable high-power microwave beam.

2. A method for steering a high power microwave array beam, the method comprising:

providing a plurality of microwave elements in an array;

coupling each of a plurality of high-power microwave modules to a different microwave element in the array;

optically triggering the high-power microwave modules to produce high-power microwave pulses to the microwave elements in the array; and delaying the high-power microwave pulses by at least one of delaying laser light used for optically triggering the high-power microwave modules and introducing an RF delay to the output of the high-power microwave module.

3. The method of claim 2, wherein varying the time of production of the high-power microwave pulses further comprises utilizing the photoconductive switches to switch a high-voltage source to ground with activation by the light pulses for the production of high-power microwave pulses.

4. The method of Claim 1, and further comprising a fiber optic delay line for delaying the light pulses from the laser, whereby corresponding photoconductive switches are activated in a predetermined timed fashion based on a delay associated with the fiber optic delay line.

5. The method of claim 3, wherein varying the time of production of the high-power microwave pulses includes the RF time delay circuit coupled to each of the elements in the array for delaying the high-power microwave pulses generated by the activation of the associated photoconductive switch in the high-power microwave modules.

6. The method of claim 5, wherein the RF delay circuit includes a waveguide and a series of layers of dielectric material in the waveguide, wherein the dielectric material has a variable dielectric constant based on a signal impressed thereacross.

7. The method of claim 6, wherein layers of dielectric material have exponentially increased thicknesses.

8. The method of claim 6, wherein the signal used to vary the dielectric constant of the dielectric material is a voltage impressed across the dielectric material.

9. A method for illuminating a target with a set of high power microwave pulses from a vehicle moving with respect to the target to increase the number of high power microwave pulses impinging on the target, comprising:

generating the set of high-power microwave pulses utilizing an array of microwave elements to form a beam, wherein the generating is done by coupling a high voltage source to a plurality of switches in each of a plurality of high power modules to provide high-power pulses;

delaying the high-power pulses using an RF delay unit and delivering to a microwave waveguide; and steering the beam towards the target, whereby the beam from the vehicle can be made to track the target as the vehicle moves past the target.

10. An apparatus for illuminating a target with a set of high power microwave pulses from a vehicle moving with respect to the target so as to increase the number of high power microwave pulses impinging on the target, comprising:

a microwave radar for generating a set of high-power microwave pulses utilizing an array of microwave elements so as to form a beam, the microwave radar comprising;

an optical section having a laser coupled to an optical time delay unit that generates individual optical signals that are amplified by optical amplifiers;

an RF section having a plurality of high power microwave modules coupled to the amplified optical signals, wherein the high power microwave modules comprise a plurality of photoconductive switches configured to provide high-power microwave pulses that are coupled to an RF time delay unit to delay the high-power microwave pulses; and a beam steering unit steering the beam towards the target, whereby the beam from the vehicle tracks the target as the vehicle moves past the target.

11. The apparatus of claim 10, wherein the photoconductive switches within each of the modules provide the high-power microwave pulses by grounding a high-voltage source and further comprising:

a laser generating laser pulses to actuate the photoconductive switches to generate the high-power microwave pulses.

12. The apparatus of claim 11, wherein the optical delay line provides delays in an activation of the corresponding photoconductive switches to generate the high-power microwave pulses at differing times to establish a phase delay in the high-power microwave pulses from the elements for beam steering.

13. The apparatus of claim 11, wherein each of the plurality of RF delay lines is coupled to a different one of the high power microwave modules for delaying pulses generated by the associated module to establish a predetermined phase delay in the pulses emitted by set elements for beam steering.

14. The apparatus of claim 13, wherein the RF delay lines include a number of stacked layers of dielectric material in a waveguide, the dielectric constant of the dielectric material being variable in accordance with the application of a signal thereacross to control the amount of delay associated with the delay line.

15. The apparatus of claim 14, wherein the layers of dielectric material have exponentially increased thicknesses.

16. The apparatus of claim 14 wherein the signal includes a voltage for the control of the delay in the associated delay line.

17. The apparatus of claim 11, wherein the optical delay line provides zero delay in the activation of the corresponding photoconductive switches to simultaneously generate microwave pulses.

* * * * *